United States Patent [19]

Kawakami et al.

[11] 4,380,008

[45] Apr. 12, 1983

[54] METHOD OF DRIVING A MATRIX TYPE PHASE TRANSITION LIQUID CRYSTAL DISPLAY DEVICE TO OBTAIN A HOLDING EFFECT AND IMPROVED RESPONSE TIME FOR THE ERASING OPERATION

[75] Inventors: Hideaki Kawakami, Mito; Masaaki Kitazima, Hitachi; Naoyuki Izaki, Hitachi; Yoshiharu Nagae, Hitachi, all of Japan

[73] Assignee: Hitachi, Ltd., Tokyo, Japan

[21] Appl. No.: 80,201

[22] Filed: Oct. 1, 1979

[30] Foreign Application Priority Data

Sep. 29, 1978 [JP] Japan ..... 53-119374
Oct. 18, 1978 [JP] Japan ..... 53-127376

[51] Int. Cl.[3] ..... G09G 3/36

[52] U.S. Cl. ..... 340/784; 340/805; 350/346

[58] Field of Search ..... 340/784, 805; 350/349, 350/346

[56] References Cited

U.S. PATENT DOCUMENTS

| | | | |
|---|---|---|---|
| 3,833,287 | 9/1974 | Taylor et al. | 350/349 |
| 3,837,730 | 9/1974 | Hatfield | 340/784 |
| 3,891,307 | 6/1975 | Tsukamoto et al. | 340/784 |
| 3,895,372 | 7/1975 | Kaji et al. | 340/784 |
| 3,911,421 | 10/1975 | Alt et al. | 340/784 |
| 3,922,667 | 11/1975 | Ueda et al. | 340/784 |
| 3,936,815 | 2/1976 | Kogure et al. | 350/346 |
| 3,977,769 | 8/1976 | Tsukamoto et al. | 350/346 |
| 3,995,942 | 12/1976 | Kawakami et al. | 340/784 |
| 4,048,633 | 9/1977 | Sano | 340/784 |
| 4,106,853 | 8/1978 | Boswell | 350/333 |
| 4,109,241 | 8/1978 | Shanks | 340/784 |
| 4,212,011 | 7/1980 | Waldron | 340/784 |
| 4,231,035 | 10/1980 | van Doorn et al. | 340/805 |

OTHER PUBLICATIONS

*Pulse Length Modulation Achieves Two-Phase Writing in Matrix-Addressed Liquid Crystal Information Displays;* Walter et al.; IEEE Transactions on Electron Devices; ED-25, #2; 2/78; pp. 172-174.

*Primary Examiner*—Marshall M. Curtis
*Attorney, Agent, or Firm*—Antonelli, Terry & Wands

[57] ABSTRACT

Disclosed is a method of driving a matrix type display panel which includes a phase transition liquid crystal layer sandwiched between a pair of electrode groups arranged in the form of a matrix and including at least one transparent electrode group, and employs intersecting portions of said electrode groups as display segments for displaying information by driving one electrode group with the one-line-at-a-time scanning system; wherein a write-in voltage signal having a sufficient root mean square value for the phase transition of the liquid crystal layer and an erasing voltage substantially equal to OV are employed to drive the panel, and segments just subjected to scanning are applied with the write-in voltage signal when information is written in the segments and are applied with the erasing voltage when information written in the segments is erased.

6 Claims, 21 Drawing Figures

METHOD OF DRIVING A MATRIX TYPE PHASE TRANSITION LIQUID CRYSTAL DISPLAY DEVICE TO OBTAIN A HOLDING EFFECT AND IMPROVED RESPONSE TIME FOR THE ERASING OPERATION

BACKGROUND OF THE INVENTION

The present invention relates to a method of driving a liquid crystal display device which employs a phase transition liquid crystal.

In typical liquid crystal display devices, a pair of glass plates are spaced apart by a spacer to form therebetween a gap of tens of microns, into which gap a liquid crystal is introduced. Between the glass plates are provided a pair of electrodes each having a desired display pattern, the upper one of which is formed of a transparent conductive film while the lower electrode is formed of a transparent conductive film or metal film depending upon how the devices are employed. In some of such devices, a phase transition liquid crystal, for example, a nematic-cholesteric phase transition liquid crystal is employed. Such a phase transition liquid crystal exhibits an effect between the peak value or root mean square value of the applied voltage and the relative brightness which is similar to a hysteresis effect. This effect is hereinafter referred to as the holding effect. When a liquid crystal, which has been applied with a holding voltage and is made low in brightness, is next applied with a write-in voltage to obtain a high brightness and then applied again with the holding voltage, the liquid crystal can maintain the high brightness due to the above-mentioned holding effect. In the past there have been known various driving methods in which a holding voltage is applied to a liquid crystal in order to enhance the speed of phase transition or to prolong the memory time (or the holding time).

A typical example of such driving methods is disclosed in, for example, an article entitled "Pulse-Length Modulation Achieves Two-Phase Writing in Matrix-Addressed Liquid-Crystal Information Displays", by Karl Heinz Walter and Miroslav Karl Taner, IEEE Transactions on Electron Devices, Vol. ED-25, No. 2, February 1978, pp 172 to 174. In this method, a liquid crystal display device is employed which includes upper and lower (X- and Y-) electrodes arranged in the form of a matrix, wherein selected ones of the upper and lower elecctrodes are applied with voltages so that a liquid crystal picture element defined by a cross point of the selected upper and lower electrodes is applied with an electric field in the direction of thickness, and a desired numeral, character, or picture image is displayed by a plurality of such picture elements.

Further, this driving method is based upon an effect similar to the hysteresis effect between the intensity of electric field established across a liquid crystal layer (or the peak value of applied voltage) and the relative brightness, and therefore applies to the liquid crystal layer an erasing, write-in, or holding voltage which is formed by changing the peak value of pulse applied to each electrode, to drive the device in a time-divisional fashion. However, in this method, in order to prevent the flicker on a liquid crystal display plane, it is required to employ a frame frequency of more than 30 Hz, and moreover the pulse duration of applied voltage cannot be made shorter than a limit to obtain a satisfactory display. Accordingly, the frame frequency is smaller than an upper limit, and therefore the response speed in writing and erasing information is slow and it is difficult to increase the number of picture elements.

Further, a U.S. Pat. No. 3,833,287 to Taylor et al discloses a method of driving a matrix type guest-host liquid crystal display device in which the above-mentioned holding effect is utilized to display picture images. In this method, since the device is driven based upon the hysteresis effect between the peak value of applied voltage and the relative brightness the pulse duration of applied voltage cannot be made shorter than a limit, and therefore it is hard to enhance the response speed in writing information.

U.S. Pat. No. 3,976,362 to Kawakami discloses a method of driving a matrix type liquid crystal display device with a one-line-at-a-time scanning system in which the display of picture image is controlled on the basis of the root mean square value of voltage applied to each picture element. In this driving method, the frame frequency can be made high because the picture image is displayed based upon the root mean square value of applied voltage. However, the method does not employ a phase transition liquid crystal, and therefore cannot utilize the holding effect. Accordingly, when the number of picture elements is increased, flicker appears on the picture plane, and therefore it is difficult to increase the number of picture elements.

SUMMARY OF THE INVENTION

An object of the present invention is to overcome the above-mentioned drawbacks of conventional driving methods.

Another object of the present invention is to provide a method of driving a liquid crystal display device including a phase-transition type liquid crystal which can display information at a high response speed.

A main feature of the present invention resides in that, in a matrix type display device employing a phase-transition type liquid crystal, the relative brightness of each liquid crystal cell is controlled in accordance with a root mean square value of a voltage applied thereto, and each liquid crystal cell is applied, in erasing a displayed picture image, with a voltage lower than a threshold voltage for putting the liquid crystal cell in a display state, for example, with a voltage equal to or a little greater than 0 V.

These and other objects, features and advantages of the present invention will become more readily apparent from the following detailed description given in conjunction with the accompanying drawings.

BRIEF DESCRIPTION OF THE PREFERRED EMBODIMENTS

Prior to description of the present invention, explanation will be made on a conventional method of driving a matrix type liquid crystal display device which is a basis of the present invention, with reference to FIGS. 1 to 4.

Figure 1A:
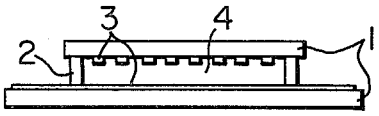
FIGS. 1A and 1B show schematically a structure of a matrix type liquid crystal display device according to the prior art.
Figure 1B:
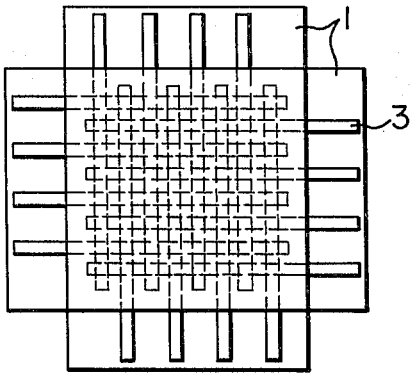

FIGS. 1A and 1B show a conventional liquid crystal matrix display device of the transmission type, FIG. 1A and FIG. 1B respectively showing a side view and a plan view. In the figures, two glass plates 1, each having a thickness of several millimeters and being provided on one of its principal surfaces with the stripes of transparent, conductive film (Nesa film) 3, are superposed one upon the other in such a manner that the stripes of one glass plate are perpendicular to those of the other glass plate while those principal surfaces of the glass plates which carry thereon the stripes of the film 3 are faced towards each other. Between the two superposed glass plates 1 is inserted an insulating spacer having a thickness of several to several tens of microns. The space defined by the plates 1 and the spacer 2 is filled with a liquid crystal material 4. With this structure, the stripes of Nesa film 3 on both the glass plates 1 form a matrix so that each cross point of any two perpendicular stripes of Nesa film 3 serves as a picture element.

Figure 2:
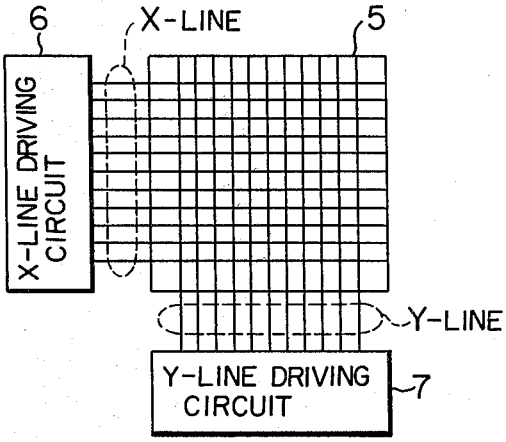
FIG. 2 shows driving means of the matrix type liquid crystal display device shown in FIG. 1.

A matrix type liquid crystal display panel 5 having the above-mentioned structure is driven with a one-line-at-a-time scanning system using an X-line driving circuit 6 and a Y-line driving circuit 7 which are shown in FIG. 2.

Figure 3:
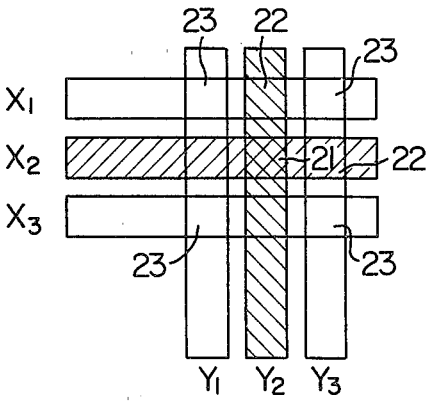
FIG. 3 shows a method of driving a liquid crystal matrix.

FIG. 3 shows a state of a display device at a certain time; $X_1$, $X_2$ and $X_3$ indicating X-line electrodes and $Y_1$, $Y_2$ and $Y_3$ Y-line electrodes. The X-line electrodes $X_1$, $X_2$ and $X_3$ are selected in scanning respectively in the order described. Picture signals are applied to the Y-line electrodes $Y_1$, $Y_2$ and $Y_3$. In FIG. 3, there is seen a case where the electrodes $X_2$ and $Y_2$ are selected, hatched for identification. Though only one Y-line electrode $Y_2$ is selected in FIG. 3 for the sake of simplicity, a plurality of Y-line electrodes may be simultaneously selected in accordance with the picture to be displayed. Here, some definitions should be introduced: the cross point or picture element 21 between two selected electrodes, i.e. $X_2$ and $Y_2$ is called the "selected state"; the cross points, e.g. points indicated by reference numeral 22, between a selected electrode and a non-selected one are called "the half-selected state"; and the cross points, e.g. points indicated by reference numeral 23, between two non-selected electrodes are called the "non-selected state". The X-line and Y-line electrodes are also referred to hereinafter as scanning and signal electrodes, respectively.

Figure 4:
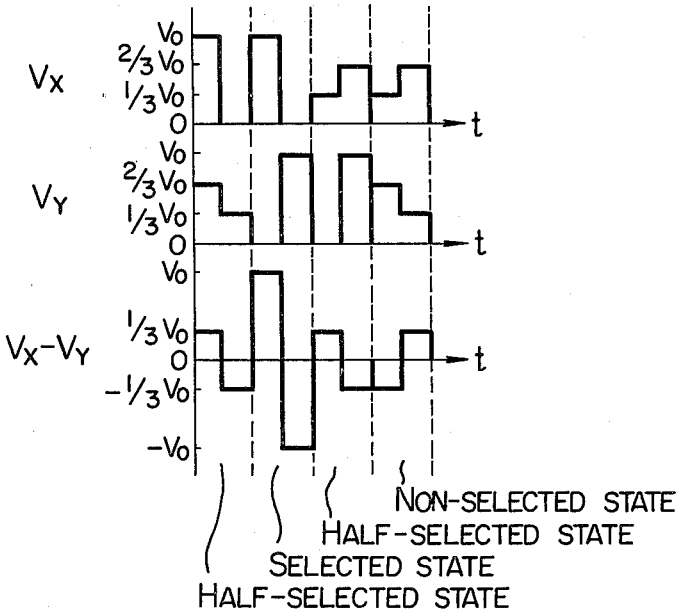
FIG. 4 is a waveform diagram for explaining a conventional method of driving a matrix type liquid crystal display device.

One of the known scanning methods is the amplitude selective multiplexing method, of which the $\frac{1}{3}$ or $\frac{1}{2}$ bias method are preferably used in the prior art. FIG. 4 shows the $\frac{1}{3}$ bias method. The $\frac{1}{3}$ bias method is characterized in that either of the voltages at the half-selected and non-selected states is one third in amplitude of the voltage at the selected state, and that the cross-talk voltage is one third of the selected voltage.

It has been found that a remarkable holding effect is obtained by a guest-host type phase transition liquid crystal which is made by adding a pleochroic dye to a nematic-cholesteric phase transition liquid crystal or a chiralnematic liquid crystal. The chiralnematic liquid crystal is made by adding an optically active material, for example, CB-15 having a constitutional formula

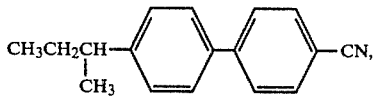

in a concentration of 2 to 5% by weight, to a biphenyl type, ester type, azoxy type, or cyclohexane type nematic liquid crystal, for example, to ZL I-1132 (cyclohexane type) manufactured by the Merck Co. An azo type, anthraquinone type, or cyanine type dye, for example a pleochroic cyanine dye NK-2233 (blue) is added in a concentration of 1% by weight to the above-mentioned chiralnematic liquid crystal to form a guest-host type phase transition liquid crystal. Now, explanation will be made on the electrooptical characteristic of a liquid crystal cell which contains the above guest-host type phase transition liquid crystal.

Figure 5:
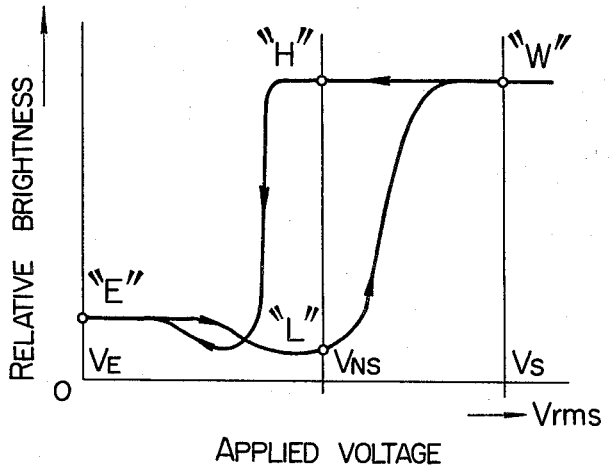
FIG. 5 is a graph showing a characteristic of a guest-host type phase transition liquid crystal employed in the present invention.

The inventors discovered that the relative brightness of the liquid crystal cell exhibited, as shown in FIG. 5, hysteresis against the root mean square value of applied voltage. That is, the relative brightness is defined by the root mean square value of applied voltage, and the path of relative brightness at the rising time of voltage is different from that at the falling time. Further, it was found that other guest-host type phase transition liquid crystals could exhibit the same hysteresis.

In the driving methods making use of such a holding effect, the following operation is preferable since a low voltage drive can be conducted. Referring to FIG. 5, the panel is first applied with a holding voltage $V_{NS}$ which is lower than a threshold voltage capable of turning the liquid crystal on, and is thereby brought in an initial state ∓L". When information is written in the liquid crystal, only selected picture elements are applied with a write-in voltage $V_S$ which is sufficient to turn the liquid crystal on, and are thereby put in a state "W" of high brightness. When the writing operation has been completed, the selected picture elements are applied with the holding voltage $V_{NS}$ to be kept in a state indicated by "H". That is, a character or picture image is displayed by two states, namely, the state "L" of low brightness and the state "H" of high brightness. When the character or picture image is erased, picture elements are applied with an erasing voltage $V_E$ which is lower than the threshold voltage, for example, 0 V, in order to erase the written-in information. Thus, the panel is put in a state of "E". When such an erasing voltage is employed, the selected picture elements can be brought from the state "H" of high brightness to the state "E" of low brightness in about 100 milliseconds. That is, the picture image can be erased very rapidly.

In order to perform the above operation, the one-line-at-a-time scanning system is employed as the scanning system of the matrix type liquid crystal display device, and the amplitude selective multiplexing method is employed as the driving method.

Figure 6:
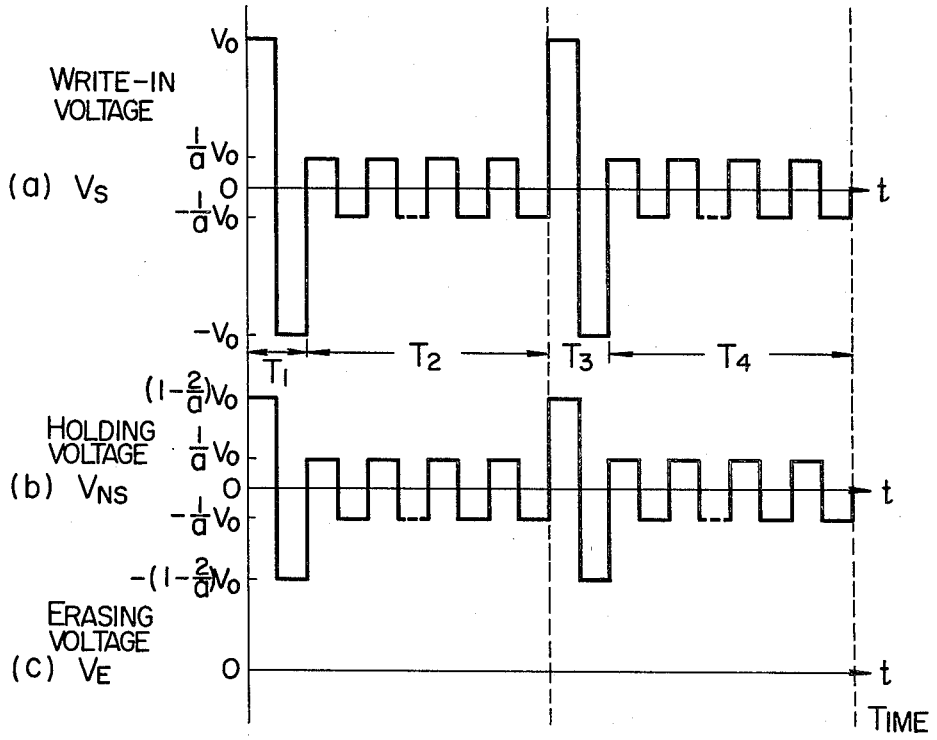
FIGS. 6 to 8 are waveform diagrams each for showing a liquid crystal driving signal employed in the present invention.

In a case where the liquid crystal display is conducted with the one-line-at-a-time system, the voltage applied to a liquid crystal cell has such waveforms as shown in FIG. 6. FIG. 6(*a*) shows the waveform of the write-in voltage $V_S$ for turning a liquid crystal cell on. In FIG. 6, reference character $T_1$ denotes a period when an X-line electrode corresponding to a turned-on cell is scanned, and a cell applied with voltages $\pm V_o$ is put in a selected state and turned on. Reference character $T_2$ denotes a period when other X-line electrodes are scanned, and the cell is applied with voltages $\pm V_o/a$ (where a indicates a bias ratio). In the period $T_2$, the cell is put in a half-selected state, and the turn-on state of the cell is maintained. One scanning of a matrix type liquid crystal display panel is performed for the periods $T_1$ and $T_2$. FIG. 6(*b*) shows the waveform of the holding voltage $V_{NS}$ for putting the cell in the half-selected state. Referring to FIG. 6(*b*), the cell is applied with voltages $$\pm\left(1-\frac{2}{a}\right)V_o$$

during the period $T_1$ when the X-line electrode corresponding to the cell is scanned, and is applied with voltages $\pm V_o/a$ during the period $T_2$ when other X-line electrodes are scanned. FIG. 6(*c*) shows the erasing voltage, and the liquid crystal cell is applied with 0 V or a voltage which is a little greater than 0 V, to erase the written-in picture image.

In the above case, the root mean square values of the write-in voltage $V_S$ and holding voltage $V_{NS}$, as is shown in the previously-mentioned U.S. Pat. No. 3,976,362, are given by the following equations:

$$V_S=\frac{1}{a}V_o\sqrt{1+\frac{a^2-1}{N}} \quad (1)$$

$$V_{NS}=\frac{1}{a}V_o\sqrt{1+\frac{(a-2)^2-1}{N}} \quad (2)$$

where N indicates the number of scanning lines (or X-lines), and a a bias ratio equal to or greater than 2.

As is apparent from equations (1) and (2), $V_S$ is greater than $V_{NS}$. $V_S$ is employed as the write-in voltage of a selected liquid crystal cell, and $V_{NS}$ is employed as the holding voltage. In this case, the ratio of $V_S$ to $V_{NS}$ is given by the following equation:

$$\frac{V_S}{V_{NS}}=\sqrt{\frac{N+a^2-1}{N+(a-2)^2-1}} \quad (3)$$

As is apparent from equation (3), when the number of scanning lines is fixed, the ratio $V_S/V_{NS}$ can be changed, that is, can be fitted to the characteristic shown in FIG. 5, by appropriately selecting the bias ratio a.

Figure 7:
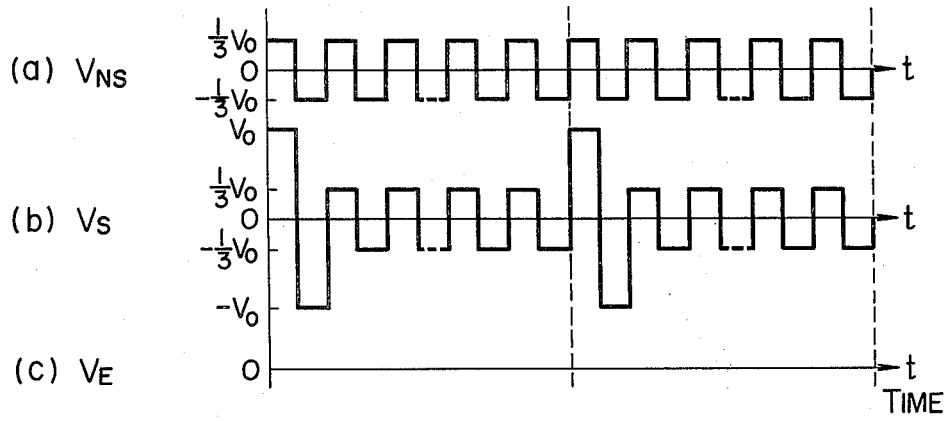
Figure 8:
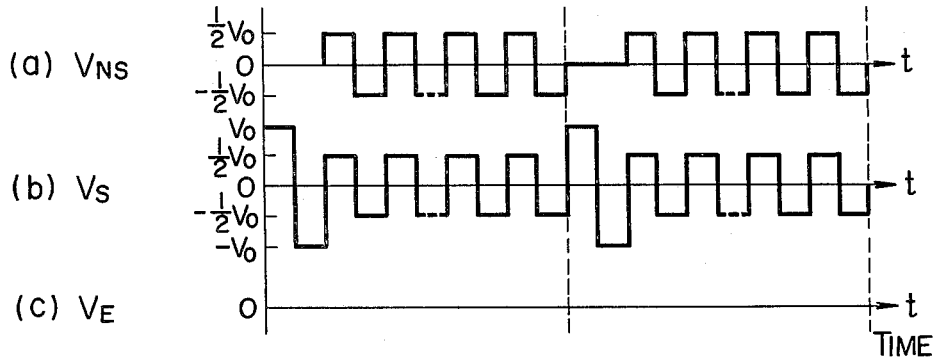

FIGS. 7 and 8 show examples of the amplitude selective multiplexing method. FIG. 7 shows the driving waveforms (voltage waveforms applied to a liquid crystal cell) for effecting the $\frac{1}{3}$ bias method in which a bias voltage is equal to one third of a selective voltage, and FIG. 8 shows the driving waveforms for effecting the $\frac{1}{2}$ bias method in which a bias voltage is equal to one half of a selective voltage.

In the case where a is equal to 3:

$$V_{NS}=\tfrac{1}{3}V_o \quad (4)$$

$$V_S=\tfrac{1}{3}V_o\sqrt{1+\frac{8}{N}} \quad (5)$$

$$\frac{V_S}{V_{NS}}=\sqrt{1+\frac{8}{N}} \quad (6)$$

In the case where a is equal to 2:

$$V_{NS}=\frac{V_o}{2}\sqrt{\frac{N-1}{N}} \quad (7)$$

$$V_S=\frac{V_o}{2}\sqrt{\frac{N+3}{N}} \quad (8)$$

$$\frac{V_S}{V_{NS}}=\sqrt{\frac{N+3}{N-1}} \quad (9)$$

In FIGS. 6, 7 and 8, there is shown the erasing voltage equal to 0 V.

Figure 9:
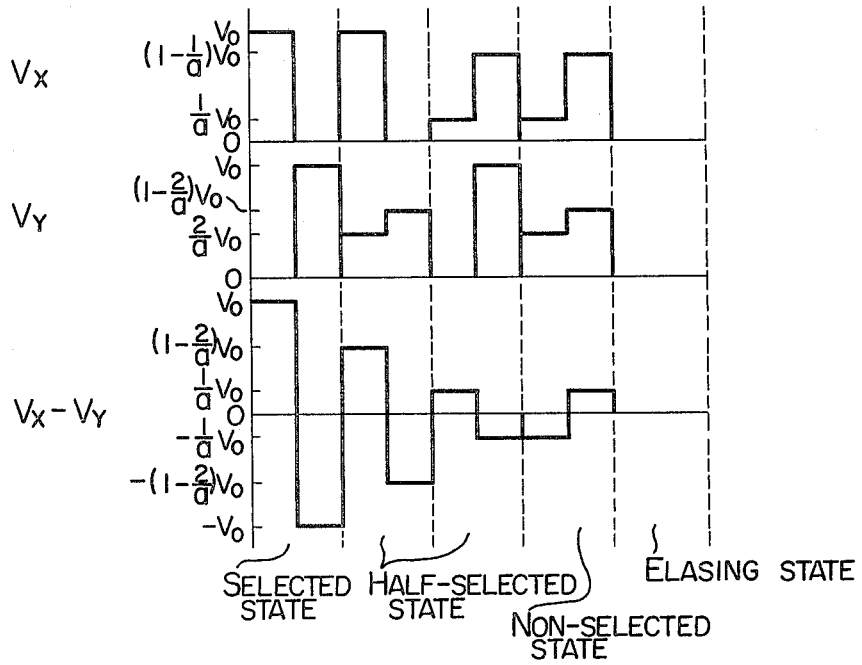
FIG. 9 shows various states of a liquid crystal driving signal employed in the present invention.

FIG. 9 shows a relation between voltages $V_X$ and $V_Y$ applied respectively to X- and Y-lines and a voltage $V_X-V_Y$ applied to a liquid crystal cell which is formed at the cross point of the X- and Y-lines. Referring to FIG. 9, when one of the X- and Y-lines is applied with a voltage $V_o$ and the other is applied with 0 V, the voltage $V_X-V_Y$ applied to the liquid crystal cell becomes equal to $V_o$, and the cell is put in the selected state. At this time, the cell is turned on. When one of the X- and Y-lines is applied with $V_o$ and the other is applied with $$\frac{2}{a}V_o \text{ or } \left(1-\frac{1}{a}\right)V_o,$$

or when one of the X- and Y-lines is applied 0 V and the other is applied with $$\frac{1}{a}V_o \text{ or } \left(1-\frac{2}{a}\right)V_o,$$

the liquid crystal cell is applied with $$\pm\left(1-\frac{2}{a}V_o\right)$$

or $\pm V_o/a$, and is put in the half-selected state. At this time, the previous state of cell is maintained. When either one of $V_o/a$, $$\left(1-\frac{1}{a}\right)V_o,$$

$$\frac{2}{a}V_o \text{ and } \left(1-\frac{2}{a}\right)V_o$$

is applied to each of the X- and Y-lines, the liquid crystal cell is applied with $\pm V_o/a$, and is put in the non-selected state. When both of the X- and Y-lines are applied with 0 V, the liquid crystal cell is also applied with 0 V, and is put in the erasing state. This state is used to erase the written-in information.

Figure 10:
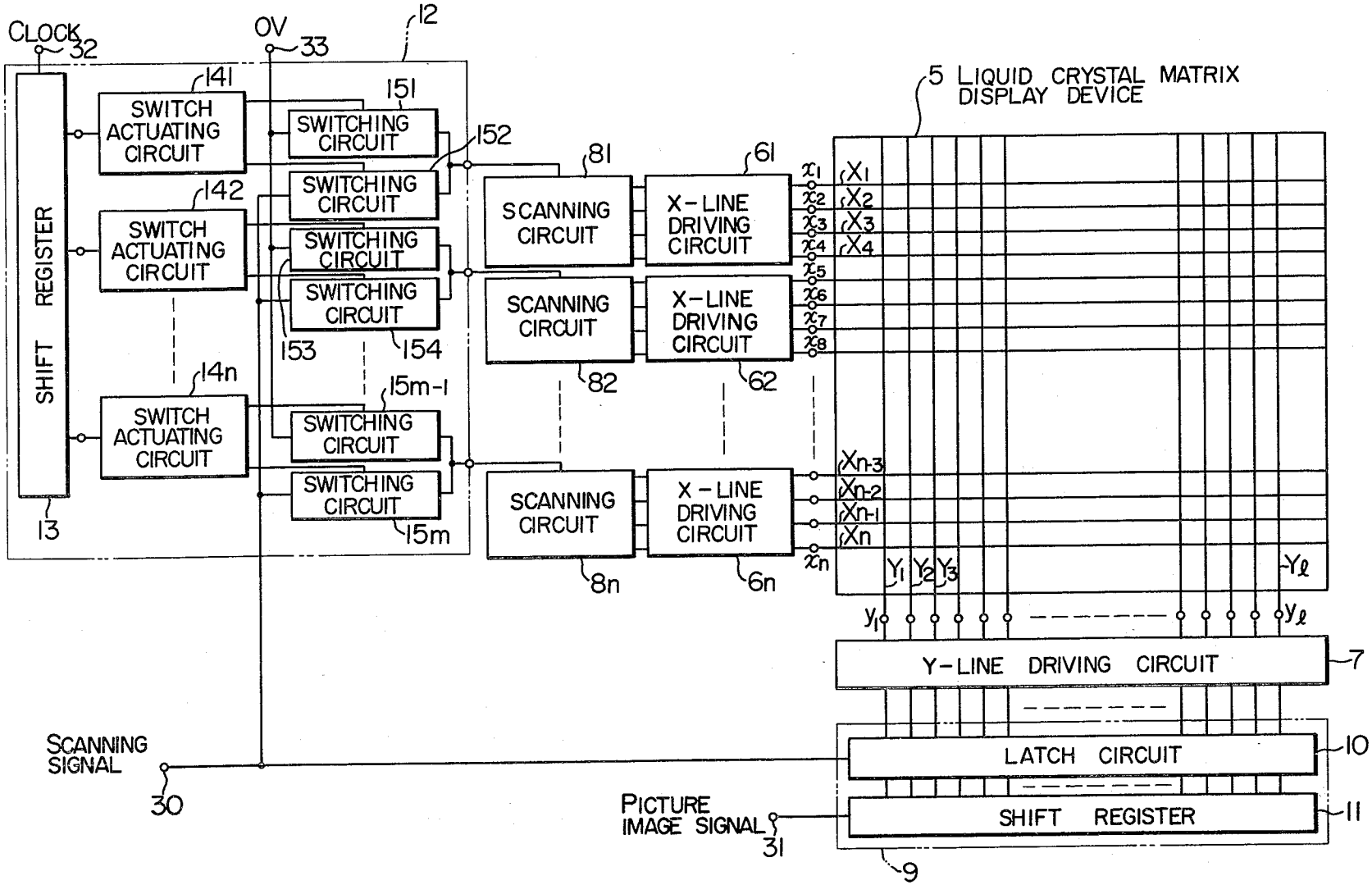
FIG. 10 is a circuit diagram of a matrix type liquid crystal display device to which a driving method according to the present invention is applied.
Figure 14:
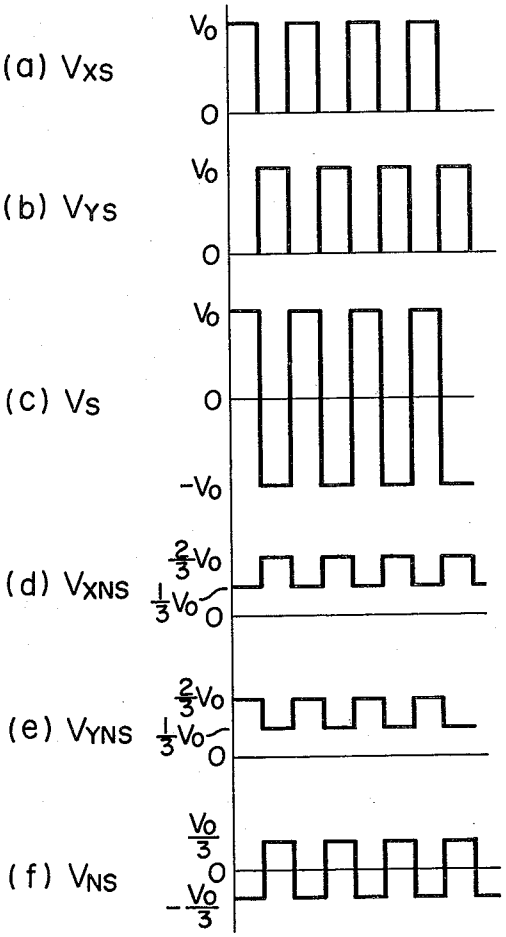
FIG. 14 is a waveform diagram for showing the waveform of a driving signal employed in the present invention.

FIG. 10 is a block diagram of a typical liquid crystal matrix display device which includes a guest-host type phase transition liquid crystal and is driven with the one-line-at-a-time scanning system employing the driving waveforms shown in FIGS. 6 to 9. Referring to FIG. 10, a matrix type liquid crystal panel 5 includes X-line electrodes and Y-line electrodes. The X-line electrodes are divided into n blocks. Each block includes X-line electrodes which are necessary to form a character, numeral, or the like, for example, 4 X-line electrodes. The n blocks are connected to n X-line driving circuits 61 to 6*n*, which are connected respectively to X-line scanning circuits 81 to 8*n*. The scanning circuits 81 to 8*n* are successively driven one by one by means of a block selecting circuit 12. The scanning circuit which is driven by the block selecting circuit 12, delivers sequentially an output signal having the level of "1" from the output terminals thereof, in response to a scanning clock which is supplied from a scanning clock input terminal 30 through the block selecting circuit 12. The driving circuit corresponding to the above scanning circuit delivers sequentially a write-in voltage $V_{XS}$ (such as shown in FIG. 14(*a*)) from the output terminals thereof, in response to the above-mentioned output signal having the level of "1". For example, when the scanning circuit 81 is driven, the driving circuit 61 delivers successively the voltage $V_{XS}$ from output terminal $x_1$, $x_2$, $x_3$ and $x_4$ in the order described, in synchronism with the scanning clock, in order to conduct successively the writing operation at X-line electrodes $X_1$, $X_2$, $X_3$ and $X_4$. At this time, those ones of output terminals $x_1$, $x_2$, $x_3$ and $x_4$ which are not applied with the voltage $V_{XS}$, are applied with a holding voltage $V_{XNS}$ (such as shown in FIG. 14(*d*)).

Figure 13:
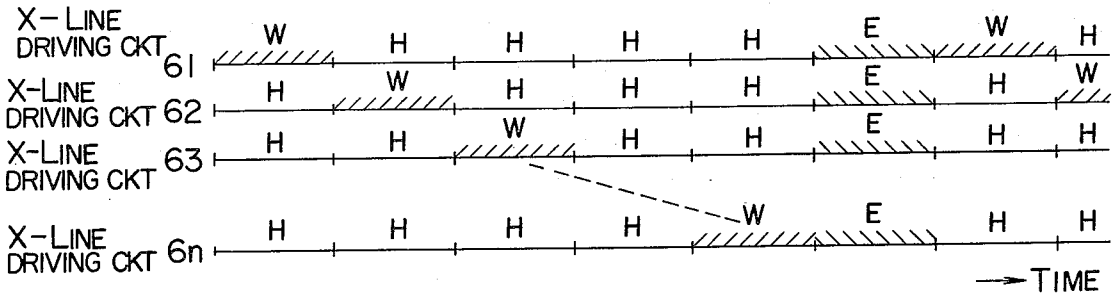
FIG. 13 is a time chart for explaining a method of driving a matrix type liquid crystal display device according to the present invention.

When the driving circuit 61 has sent out the write-in voltage $V_{XS}$ from the output terminals $x_1$, to $x_4$, the block selecting circuit 12 stops the scanning operation of the scanning circuit 81, and starts the scanning operation of the scanning circuit 82 to drive the driving circuit 62. In this manner, the driving circuit 61 to 6*n* are successively driven, and therefore the writing operation is successively performed at the X-line electrodes $X_1$, $X_2$, . . . $X_n$. Such a driving procedure is shown in FIG. 13. In this figure, reference characters W, H and E indicate the write-in state, holding state and erasing state, respectively.

When a picture image formed on the picture plane is rewritten after the driving circuits 61 to 6*n* have been successively put in the write-in state and the write-in state of the driving circuit 6*n* has terminated, all the driving circuits are put in the erasing state E to erase the picture image. That is, the voltages appearing on the output terminals of all the driving circuits are simultaneously made equal to 0 V. Subsequently, the writing operation is again performed at the driving circuits 61 to 6*n* in this order. Needless to say, one block of X-line electrodes or a part of the picture image can be erased by making the outputs of corresponding driving circuits equal to 0 V.

The Y-line electrodes are connected to a Y-line driving circuit 7 which is driven by a line memory 9. The line memory 9 includes a shift register 11 which receives from a signal input terminal 31 a picture image signal (or a binary signal) for indicating picture image information, and a latch circuit 10 which holds the contents of the shift register 11 and sends the above contents to the Y-line driving circuit 7, in response to the scanning clock supplied from the scanning signal input terminal 30. Since the Y-line driving circuit 7 simultaneously drives Y-line electrodes $Y_1$ to $Y_l$ in response to the scanning clock, the Y-line electrodes $Y_1$ to $Y_l$ are driven each time the X-line electrodes $X_1$ to $X_n$ are successively applied with the driving voltage $V_{XS}$. The Y-line driving circuit 7 applies a write-in voltage $V_{YS}$ (such as shown in FIG. 14(*b*)) to Y-line electrodes which corresponds to liquid crystal cells to be turned on, and applies a holding voltage $V_{YNS}$ (such as shown in FIG. 14(*e*)) to the remaining Y-line electrodes. Accordingly, the liquid crystal cells to be turned on are applied with a write-in voltage $V_S$ (such as shown in FIG. 14(*c*)), and the remaining cells are applied with a holding voltage $V_{NS}$ (such as shown in FIG. 14(*f*)). The erasing operation is performed as follows. The X-line electrodes to be erased are applied with 0 V by the corresponding X-line driving circuits, and simultaneously all the Y-line electrodes are applied with 0 V by the Y-line driving circuit 7.

As can be seen from the above explanation, the voltage waveform $V_S$ shown in FIG. 6(*a*)) is applied to a liquid crystal cell in which information is written, and the voltage waveform $V_{NS}$ shown in FIG. 6(*b*) is applied to a liquid crystal cell at which the previous state is maintained. The circuit for generating the write-in voltages $V_{XS}$ and $V_{YS}$ and the holding voltages $V_{XNS}$ and $V_{YNS}$ is disclosed in, for example, a U.S. Pat. No. 3,975,720 to Kawakami.

Next, explanation will be made on the block selecting circuit 12 shown in FIG. 10. Referring to FIG. 10, the block selecting circuit 12 includes a shift register 13, switch actuating circuits 141 to 14*n*, and switching circuits 151 to 15*m*. The shift register 13 receives a block signal which is a kind of clock signal, from the terminal 32, and successively supplies a signal having the level of "1" to the switch actuating circuits 141 to 14*n* each time the block signal is applied to the shift register 13. The frequency of the block signal is equal to that obtained by dividing the frequency of the scanning clock signal by the number of X-line included in one block. In the case shown in FIG. 10, the frequency of block signal is equal to one fourth of the frequency of scanning clock signal.

Figure 11:
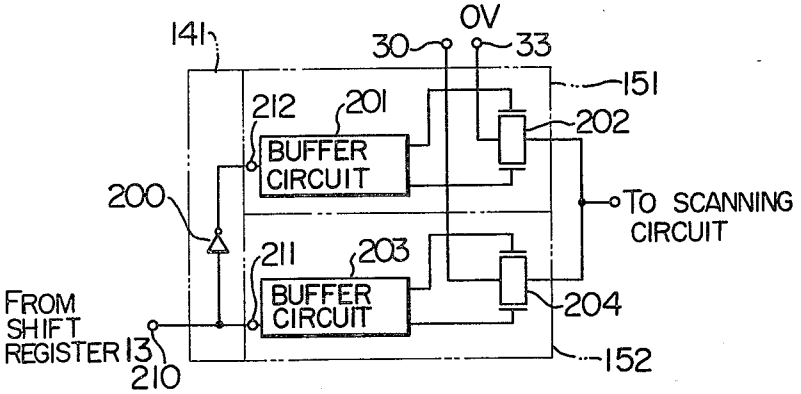
FIG. 11 is a circuit diagram showing a circuit configuration of the block selecting circuit shown in FIG. 10.

FIG. 11 shows a circuit arrangement including, for example, the switch actuating circuit 141 and the switch circuit 151 and 152. Referring to FIG. 11, an input terminal 210 of the switch actuating circuit 141 is connected to an output terminal of the shift register 13, is connected through an output terminal 211 of the circuit 141 to a buffer circuit 203 of the switch circuit 152, and is connected to a buffer circuit 201 of the switch circuit 151 through an NOT gate 200 and an output terminal 212. The output side of the buffer circuit 201 is connected to a switching element, for example, to PN electrodes of a complementary MOS (CMOS) transistor 202, which is applied with an input voltage of 0 V through a terminal 33. The output side of the buffer circuit 203 is connected to PN electrodes of a CMOS transistor 204, the input electrode of which is applied with the scanning clock signal through a terminal 33. The outputs of the CMOS transistors 202 and 204 are applied to the corresponding scanning circuit 81.

Accordingly, when the input applied from the shift register 13 to the terminal 210 is kept in the level of "1", the signal having the level of "1" is applied to the CMOS transistor 204 through the buffer circuit 203 to enable a gate formed by the transistor 204. Thus, the scanning clock signal is applied to the scanning circuit 81, and therefore the X-line electrodes $X_1$ to $X_4$ are subjected to scanning, that is, the writing operation is performed on the X-line electrodes $X_1$ to $X_4$.

When the input applied from the shift register 13 to the terminal 210 is put in the level of "0", the signal having the level of "1" is delivered from the NOT gate (inverter) 200, and is applied to the CMOS transistor 202 through the buffer circuit 201 to enable a gate formed by the transistor 202. Thus, the scanning circuit 81 is applied with 0 V, and therefore the writing operation is not performed on the X-line electrodes $X_1$ to $X_4$. As can be seen from the above, the scanning circuits 81 to **8*n* are successively driven one by one by means of the block selecting circuit 12**, in response to the block signal.

Figure 12:
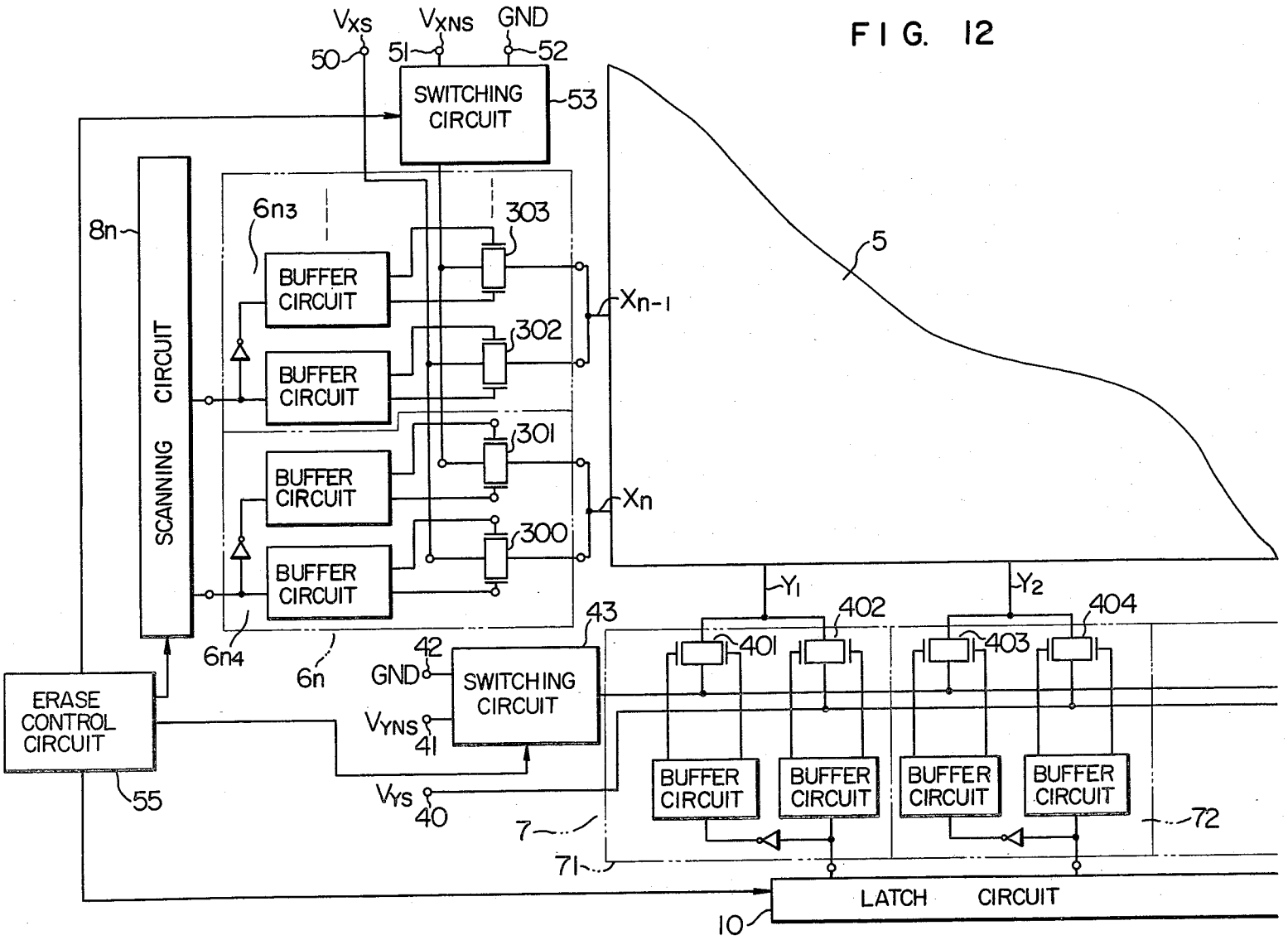
FIG. 12 is a detailed circuit diagram of the driving circuits shown in FIG. 10.

FIG. 12 shows a circuit arrangement of the X-line and Y-line driving circuits shown in FIG. 10. In FIG. 12 are shown, by way of example, only a part of the X-line driving circuit **6*n* and a part of the Y-line driving circuit 7. The X-line driving circuit 6*n* includes four X-line driving sections 6*n*1, 6*n*2, 6*n*3 and 6*n*4 corresponding respectively to the X-line electrodes $X_{n-3}$, $X_{n-2}$, $X_{n-1}$ and $X_n$. Each driving section is equal in structure to that part of the block selecting circuit 12** which includes a set of switch actuating circuits and switch circuit, namely, has the same circuit construction as shown in FIG. 11.

The scanning circuit **8*n* corresponding to the X-line driving circuit 6*n* successively applies a binary signal (or a write signal) to the X-line driving sections 6*n*1 to 6*n*4, in response to the scanning clock signal from the switch circuit 15*m*. For example, the X-line driving section 6*n*4 enables the CMOS transistor 300 in response to the signal having the level of "1" from the scanning circuit 8*n*, to apply to the X-line, electrode $X_n$ the write-in voltage $V_{XS}$ which is supplied from a terminal 50. Further, the driving section 6*n*4 enables the CMOS transistor 301 in response to the signal having the level of "0" from the scanning circuit 8*n*, to apply to the X-line electrode $X_n$ the holding voltage $V_{XNS}$ which is supplied from a terminal 51 through a switch 53**.

The Y-line driving circuit 7 includes nY-line driving sections 71, 72, . . . , **7*l* which correspond respectively to the Y-line electrodes $Y_1$, $Y_2$, . . . , $Y_l$. Each Y-line driving section has the same circuit construction as the X-line driving section. For example, the Y-line driving section 71 enables a CMOS transistor 402 upon the application of a signal having the level of "1" or a write signal from the latch circuit 10, to apply to the Y-line electrode $Y_1$ the write-in voltage $V_{YS}$ which is supplied from a terminal 40. Further, the Y-line driving section 71 enables a CMOS transistor 401 in response to a signal having the level of "0" from the latch circuit 10, to apply to the electrode $Y_1$ the holding voltage $V_{YNS}$ which is supplied from a terminal 41 through a switching circuit 43**.

In a case when the erasing operation is performed, all of the outputs of the latch circuit 10 and all or a part of the outputs of the scanning circuits 81 to **8*n* are brought in the level of "0" by means of an erase control circuit 55 according as the whole or a part of a picture image is erased, and further the switching circuits 43 and 53 are changed over respectively to the side of a terminal 42, and the side of a terminal 52** to apply a voltage of 0 V to the selected X-line electrodes and all of the Y-line electrodes.

In the circuit construction shown in FIG. 12, the X-line and Y-line electrodes are applied with 0 V when the erasing operation is performed. However, the X-line and Y-line electrodes may be applied with the same or nearly the same voltage to make the applied voltage of each liquid crystal cell equal or nearly equal to zero. In this case, the grounded terminal 52 is removed, the terminal 42 is applied with the holding voltage $V_{XNS}$ in place of 0 V, and the switch 43 is changed over to the side of the terminal 42 when the erasing operation is performed.

As has been explained in the foregoing, a matrix type liquid crystal device employing a guest-host type phase transition liquid crystal can be operated with the one-line-at-a-time scanning system based upon the holding effect of the guest-host type phase transition liquid crystal that the relative brightness thereof is maintained over a range of the root mean square value of applied voltage. In this device, moreover, the erasing operation can be performed at a high response speed by applying a voltage equal to or nearly equal to 0 V to liquid crystal cells to be erased.

Further, since a nematic-cholesteric phase transition liquid crystal and a chiralnematic phase transition liquid crystal are possessed of the same holding effect, the above-mentioned driving method is applicable to a device employing these liquid crystals, and the erasing time can be made very short.

With the above-mentioned circuit arrangement, the ratio of the holding voltage to the write-in voltage can be appropriately set in any one of a nematic-cholesteric phase transition liquid crystal, a chiralnematic liquid crystal and a guest-host type liquid crystal made by adding a pleochroic dye to these liquid crystals. Accordingly, a desirable driving condition can be determined in accordance with the characteristic of liquid crystal used, and such a display characteristic as contrast can be optimized.

Next, explanation will be made on a case where the driving method according to the present invention is applied to the time division driving method of a liquid crystal numeric display device employing any one of a nematic-cholesteric phase transition liquid crystal, a chiralnematic phase transition liquid crystal and a guest-host type liquid crystal made by adding a pleochroic dye to these liquid crystals.

Figure 15A:
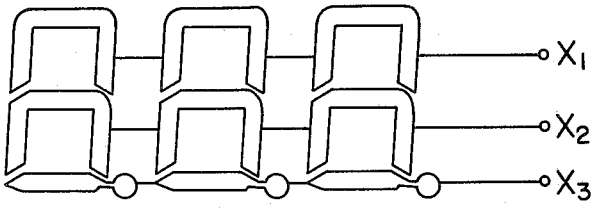
FIGS. 15A, 15B and 15C show a liquid crystal display device for displaying numerals.
Figure 15B:
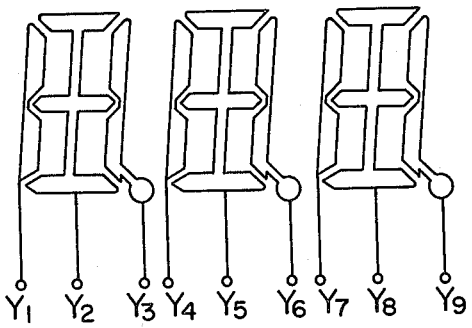

The liquid crystal numeric display device to which the time division driving method is applied, includes electrodes arranged in such a matrix structure as shown in FIGS. 15A and 15B. That is, upper electrodes $X_1$, $X_2$ and $X_3$ shown in FIG. 15A and lower electrodes $Y_1$ to $Y_9$ shown in FIG. 15B overlap each other so that the X-line and Y-line electrodes form a matrix as indicated by an equivalent circuit shown in FIG. 15C.

The time division driving method making use of the one-line-at-a-time scanning system is applied to such a matrix structure, and moreover the amplitude selective multiplexing method is employed. In more detail, it has been confirmed that the relative brightness of a guest-host type liquid crystal which is made by adding a pleochroic dye to a nematic-cholesteric phase transition liquid crystal or a chiralnematic liquid crystal, depends upon the root mean square value of applied voltage. Accordingly, the amplitude selective multiplexing method can be employed in the time division driving method of the guest-host type liquid crystal.

Figure 15C:
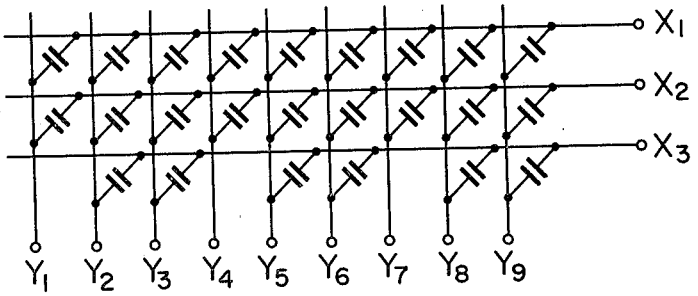

The driving waveforms which are applied to the X-line and Y-line electrodes shown in FIGS. 15A, 15B and 15C, are the same as those shown in FIG. 7 or 8, for example. That is, a liquid crystal cell to be turned on (or a selected point) is applied with the voltage $V_S$ shown in FIG. 7(*b*) or 8(*b*), and a liquid crystal cell not to be turned on (or a non-selected point) is applied with the voltage $V_{NS}$ shown in FIG. 7(*a*) or 8(*a*).

Figure 16:
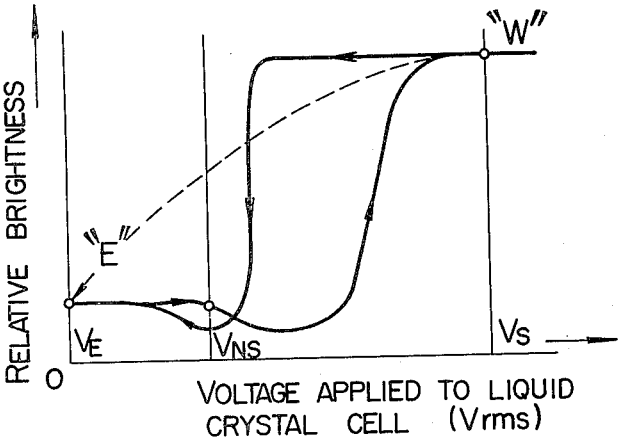
FIG. 16 shows a relation between the applied voltage and the relative brightness which is exhibited by a guest-host type phase transition liquid crystal.

FIG. 16 shows a relation of a guest-host type liquid crystal between the relative brightness and the root mean square value of applied voltage. The bias ratio a is determined on the basis of equations (1), (2) and (3) so as to obtain the voltages $V_S$ and $V_{NS}$ such as shown in FIG. 16.

Figure 17:
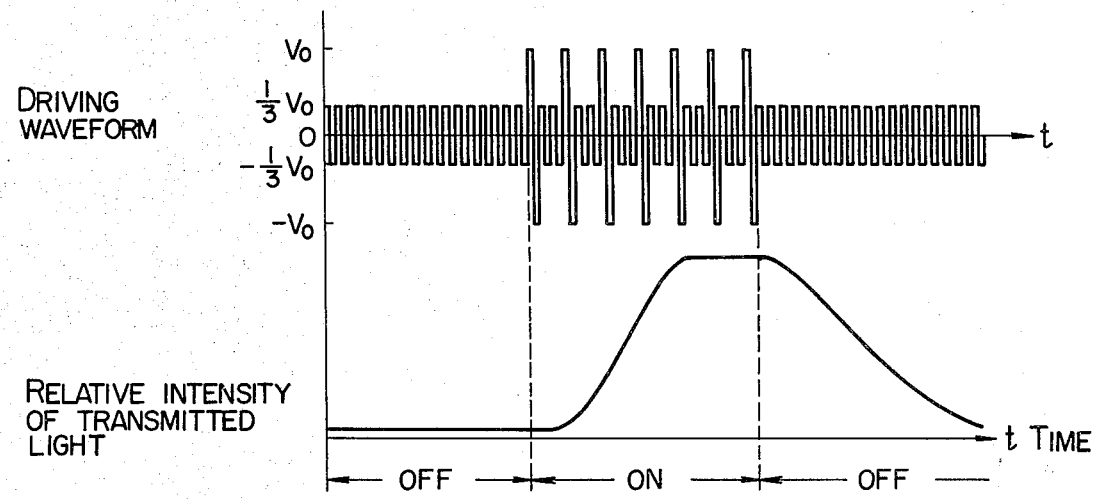
FIGS. 17 and 18 show response waveforms of relative brightness when a guest-host type phase transition liquid crystal is driven by a root mean square value of applied voltage.

FIG. 17 shows a response waveform of the relative intensity of transmitted light in a case when a guest-host type phase transition liquid crystal is driven with an amplitude selective multiplexing method, for example, with the $\frac{1}{3}$ bias method. In this case, since the guest-host type phase transition liquid crystal is possessed of the holding effect, the response speed of the liquid crystal is slow, and a falling time of several seconds is needed at room temperature. That is, it takes several seconds to erase a picture image on the liquid crystal.

Figure 18:
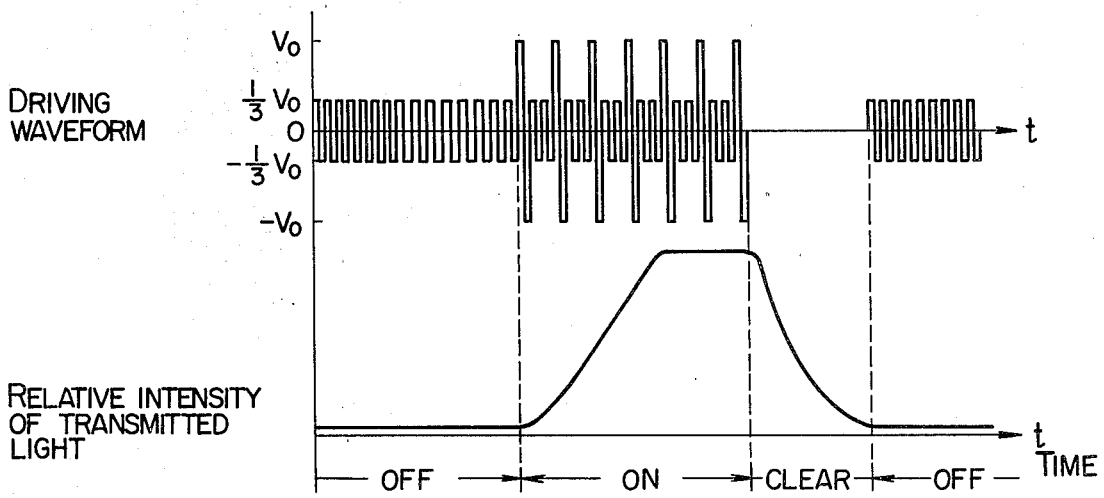

When the upper and lower electrodes of the liquid crystal element are applied with the same potential to apply a voltage of 0 V to the liquid crystal, the liquid crystal is restored to the initial state and a holding state is cleared. It has been found that when the voltage applied to the liquid crystal is changed from an operating voltage $V_o$ to 0 V, a falling time of only hundreds of milliseconds is needed. In view of the above fact, a "clear" period is provided in the erasing operation, as is shown in FIG. 18. The falling time can be reduced by making the applied voltage of liquid crystal equal to 0 V during this "clear" period. That is, when the liquid crystal is brought to the "E" state shown in FIG. 16 from the "W" state, the erasing operation can be done very quickly.

The driving circuit of the device shown in FIGS. 15A, 15B and 15C has substandially the same construction as shown in FIGS. 10 to 12. In other words, only one of the scanning circuits 81 to 8*n* is employed, and only one of the X-line driving circuits is required. Accordingly, the block selecting circuit 12 is needless.

Further, since the nematic-cholesteric phase transition liquid crystal and the chiralnematic phase transition liquid crystal are possessed of the holding effect, the above-mentioned driving method is applicable to these liquid crystals, and the erasing operation can be performed at a high response speed.

We claim:

1. An amplitude selective multiplexing method of driving a matrix type liquid crystal display device which includes a layer of guest-host type phase transition liquid crystal sandwiched between a pair of electrode groups including at least one transparent electrode group and arranged in the form of a matrix, intersecting portions of said electrode groups being employed as display segments for displaying information by driving column or row electrodes of said matrix electrode groups with a one-line-at-a-time scanning system, wherein said phase transition liquid crystal exhibits a hysteresis characteristic in the relative brightness thereof against root mean square values of applied voltage, said amplitude selective multiplexing matrix driving method comprising:

scanning said segments and applying across them a write-in voltage when the segments are to be changed from an off state to an on state, an erasing voltage when the segments are to be changed from the on state to the off state, and a holding voltage when a present on or off state of each of the segments is to be maintained; and applying a holding voltage across each of segments other than segments just subjected to scanning to maintain the present on or off state of the segments, wherein said write-in voltage has a root mean square value sufficient for effecting such a phase transition of said phase transition liquid crystal from a low brightness to a high brightness condition thereby to turn on said display device, said holding voltage has a root mean square value lower than said write-in voltage and not sufficient for effecting the phase transition of said phase transition liquid crystal thereby to hold the present brightness of said display device at the level it is at at the moment the holding voltage is applied, and said erasing voltage has a root mean square value lower than said holding voltage and sufficient for effecting such a phase transition of said phase transition liquid crystals from the high brightness to the low brightness condition thereby to turn off said display devices.

2. A method of driving a matrix type liquid crystal display device according to claim 1, wherein said matrix type liquid crystal display device includes a guest-host type liquid crystal made by adding a pleochroic dye to selected one of liquid crystals or a nematic-cholesteric phase transition liquid crystal and a chiralnematic liquid crystal.

3. A method of driving a matrix type liquid crystal display device according to claim 1, wherein said erasing voltage applied across a segment to be erased is substantially equal to 0 volt.

4. A method of driving a matrix type liquid crystal display device according to claim 3, wherein said erasing voltage across a segment to be erased is formed by simultaneously applying a voltage of substantially the same root mean square value and of substantially the same phase to each of a pair of electrodes associated with the segment.

5. A method of driving a matrix type liquid crystal display device according to claim 3, wherein said erasing voltage applied across a segment to be erased is formed by simultaneously applying a voltage substantially equal to 0 V to each pair of electrodes associated with the segment.

6. A method of driving a matrix type liquid crystal display device according to claim 1, wherein said pair of electrode groups arranged in the form of a matrix includes a multiplicity of row electrodes and a multiplicity of line electrodes divided into a plurality of groups of line electrodes, the plurality of line electrode groups being sequentially selected such that the line electrodes of the selected group are sequentially scanned, the segments of the scanned line electrode being selectively applied with one of said write-in, holding and erasing voltages and the remaining segments of the line electrodes of the selected line group being applied with said holding voltage, and the segments of the line electrodes of non-selected groups being applied with said holding voltage.

* * * * *